US006109989A

United States Patent [19]

Kelm et al.

[11] Patent Number: 6,109,989

[45] Date of Patent: Aug. 29, 2000

[54] SUBMERGED PIPELINE MANIFOLD FOR OFFLOADING MOORING BUOY AND METHOD OF INSTALLATION

[75] Inventors: Ron L. Kelm, Houston; Charles O. Etheridge, Spring; Yonghui H. Liu, Houston; Jerry L. McCollum, Hempstead, all of Tex.

[73] Assignee: FMC Corporation, Chicago, Ill.

[21] Appl. No.: 09/296,699

[22] Filed: Apr. 21, 1999

Related U.S. Application Data

[60] Provisional application No. 60/082,837, Apr. 23, 1998.

[51] Int. Cl.[7] ..... B63B 22/02

[52] U.S. Cl. ..... 441/4; 405/224.2

[58] Field of Search ..... 166/344, 345, 166/367; 441/3, 4, 5; 405/195.1, 224.2, 224.3, 224.4, 224, 158, 162, 171, 177, 154

[56] References Cited

U.S. PATENT DOCUMENTS

| | | | |
|---|---|---|---|
| 3,118,155 | 1/1964 | Siegel | 441/4 |
| 3,236,267 | 2/1966 | Bily | 441/4 |
| 3,602,174 | 8/1971 | Gorman | 441/4 |
| 3,641,602 | 2/1972 | Flory et al. | 441/5 |
| 3,677,310 | 7/1972 | Dobler et al. | 441/4 |
| 3,840,927 | 10/1974 | Reid, Jr. | 441/5 |
| 3,979,785 | 9/1976 | Flory | 441/5 |
| 4,321,720 | 3/1982 | Havre | 441/5 |
| 4,891,495 | 1/1990 | Araki . | |
| 4,892,495 | 1/1990 | Svensen | 441/5 |

*Primary Examiner*—Eileen D. Lillis
*Assistant Examiner*—Frederick L. Lagman
*Attorney, Agent, or Firm*—Gary L. Bush; Mayor, Day, Caldwell & Keeton, L.L.P.

[57] ABSTRACT

In certain offshore locations, for example off the West Coast of Africa, FPSO facilities provide an offloading facility to receive and load produced crude oil onto shuttle tankers. In such arrangements FPSO facilities use spread moored tankers with flowlines suspended in the water column to an offloading buoy or buoys which are located 1,000 to 1,500 meters away from the FPSO. Typically steel pipe flowlines as used with intermediate floatation to provide a suitable configuration that will avoid detrimental loads being imposed resulting from relative motions of the FPSO and the offloading buoy. According to the invention, a Suspended Pipe Line End Manifold (SPLEM) is connected to the end of the flowline assembly for support during towout. The SPLEM is positioned near the buoy and then connected at the sea surface to the bottom of the buoy by flexible leads such as anchor chains. The SPLEM is then flooded by selectively flooding compartments to cause it to sink to an operational position below the buoy. Next, additional submarine hoses or flexible pipe are connected to complete the flowline to the buoy.

13 Claims, 4 Drawing Sheets

SUBMERGED PIPELINE MANIFOLD FOR OFFLOADING MOORING BUOY AND METHOD OF INSTALLATION

REFERENCE TO PROVISIONAL APPLICATION

The priority of U.S. Provisional Patent Application No. 60/082,837 filed Apr. 23, 1998 is claimed.

BACKGROUND OF THE INVENTION

1. Field of the Invention

This invention relates generally to floating offloading and storage facilities for subsea hydrocarbon products, and more particularly to such offloading and storage facilities utilizing an offloading mooring buoy.

2. Description of the Prior Art

Offloading mooring buoys for shuttle tankers or other vessels have been used with floating production storage and offloading facilities, such as permanently moored storage tankers. Normally, the storage and offloading facility is connected directly to subsea product lines and receives product from subsea wells. In some locations, dependent on the various water depths and distances, an offloading mooring buoy may be located one thousand (1,000) to fifteen hundred (1,500) meters from a permanent floating storage facility. Shuttle tankers connect to the offloading mooring buoy to receive product therefrom for transport Product flowlines or risers normally extend from the subsea wells to the permanent floating storage facility, and from the storage facility to the mooring buoy for connection to the shuttle tanker for transport. In the past, such product flowlines from the storage facility to the offloading mooring buoy, particularly where the offloading mooring buoy has been spaced a substantial distance from the storage facility, have comprised metal pipes with intermediate floatation devices located along the lengths of the product flowlines to provide a suitable contour or configuration to the flowlines to avoid excessive loads resulting from the weight of the flowlines and the relative motions of the offloading mooring buoy and the floating storage facility. The installation of such metal pipe on the offloading mooring buoy requires the lifting of large loads because of the weight of the pipe. Furthermore, it has been difficult to tow the pipe to the mooring buoy from the permanent storage facility because of the weight of the pipe and the substantial distances required for towing, such as fifteen hundred (1,500) meters.

Identification of Objects of the Invention

It is an object of the present invention to provide an improved installation system for the attachment of product flowlines between two floating facilities separated by a substantial distance over about five hundred (500) meters, for example.

A further object of the invention is to provide such an installation system for a floating storage facility utilizing a pipeline manifold connected to the flowlines from the storage facility and transported to an offloading mooring buoy for connection to the offloading mooring buoy.

SUMMARY OF THE INVENTION

A pipeline manifold with empty water tight compartments is connected to the free ends of flowlines at the permanent storage facility and is then towed to a catenary anchor leg mooring (CALM) buoy for product offloading. The pipeline manifold is connected while at sea level to the bottom of the CALM by suitable flexible members, such as anchor chains. The manifold compartments are then flooded to sink the manifold and associated flowlines to a desired predetermined water depth beneath the mooring buoy. In this position, flexible connecting product flowlines are mounted between the pipeline manifold and the CALM buoy for product flow to the CALM buoy from the permanent storage facility. The flexible connecting flowlines permit pitching or rolling motions of the mooring buoy while obviating excessive stress in the metal pipes or flowlines between the permanent storage facility and the CALM buoy.

Other features, objects, and advantages of the invention will be more apparent after reference to the following drawings and specification.

BRIEF DESCRIPTION OF THE DRAWINGS

The objects, advantages and features of the invention will become more apparent by reference to the drawings which are appended hereto and wherein an illustrative embodiment of the invention is shown, of which.

DESCRIPTION OF THE INVENTION

Figure 1A:
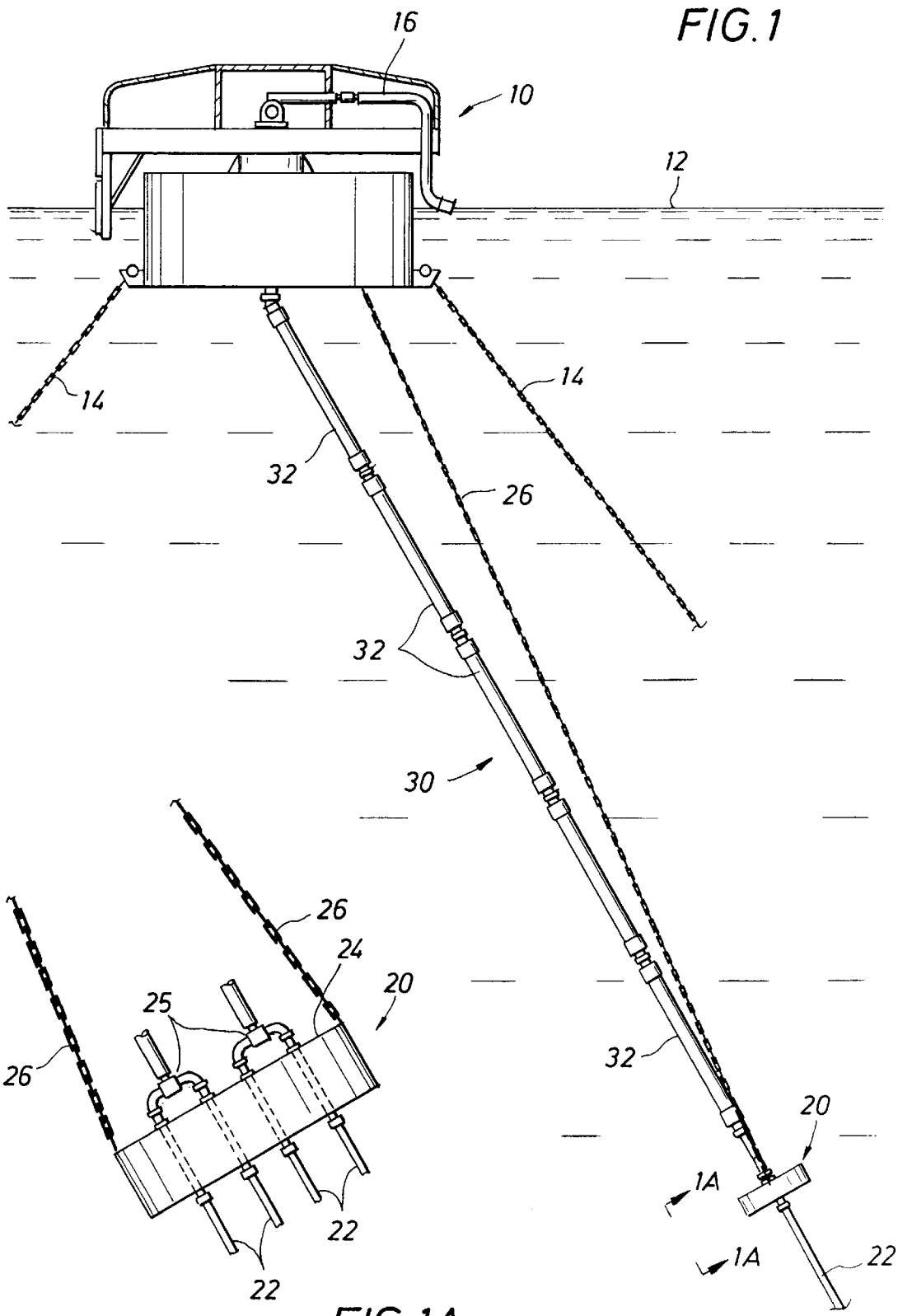
FIG. 1 is a side elevational, partly schematic, view of a submerged pipeline and manifold (SPLEM) connected to the bottom of an offloading mooring buoy, such as a CALM buoy, with a plurality of connecting flowlines extending from the pipeline manifold to the mooring buoy.
Figure 3:
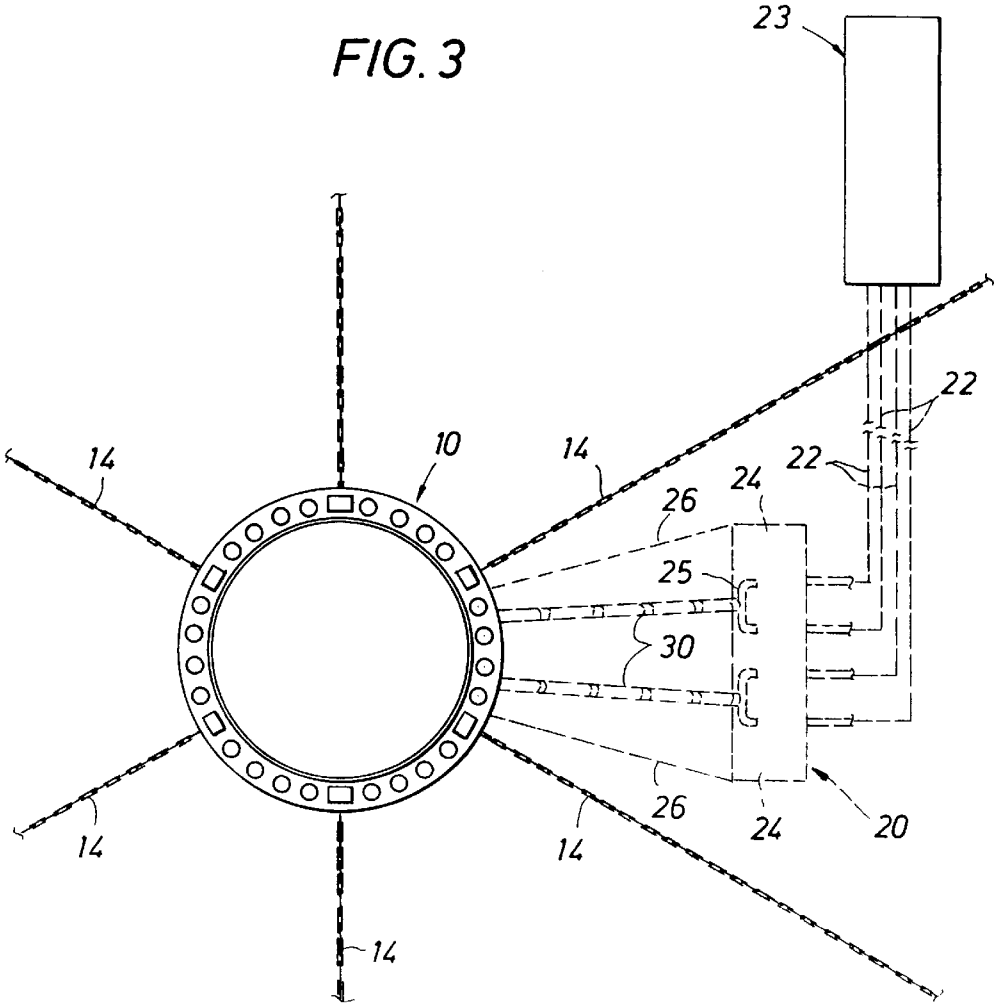
FIG. 3 is a top plan schematic view of the arrangement shown in FIGS. 1 and 2 illustrating the pipeline manifold connected to the offloading mooring buoy.
Figure 2:
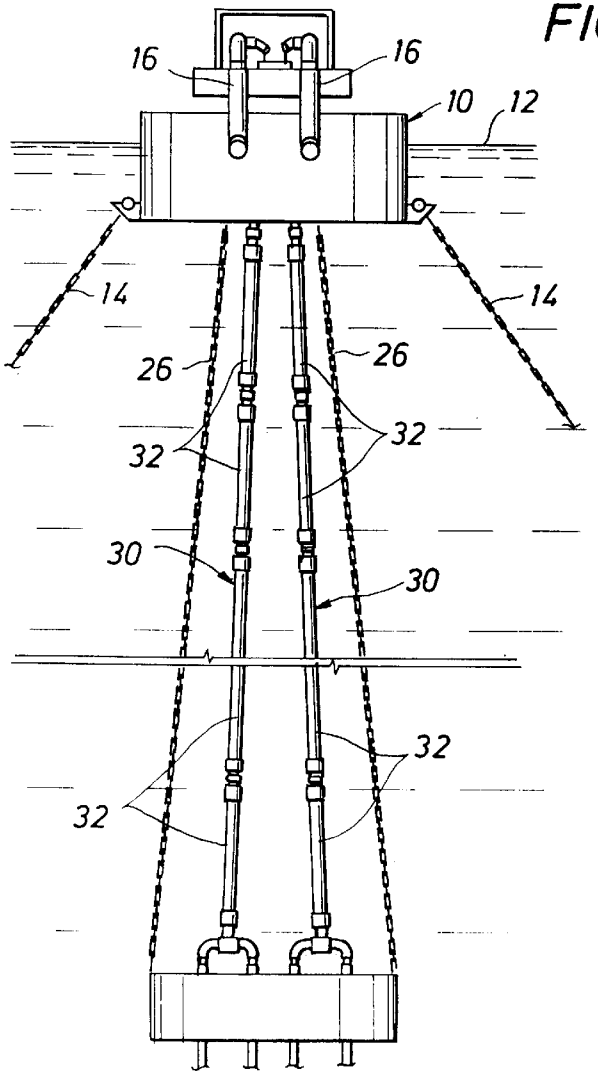
FIG. 2 is an end elevational view of the arrangement shown in FIG. 1 which shows a plurality of connected flexible hose sections forming the flexible connecting product flowlines between the pipeline manifold and the offloading mooring buoy.

Embodiment of FIGS. 1–3

Referring to the embodiment of FIGS. 1–3, a catenary anchor leg mooring (CALM) buoy is shown generally at 10 floating on the sea surface 12 and having a plurality of anchor legs 14 extending in a catenary to the sea floor and anchored thereto. Suitable product lines 16 extend from the top of buoy 10 and are adapted for connection to a product transport vessel (not shown), such as a shuttle tanker, to supply product thereto.

A submerged pipeline end manifold (SPLEM) is shown generally at 20 and has a plurality of steel product flowlines 22 connected thereto which extend from a permanent production storage facility, such as a permanently anchored storage vessel or tanker shown schematically at 23 in FIG. 3. Such storage facility may be a bottom supported facility rather than a vessel. Suitable valves and manifolds 25 for product flowlines 22 are provided to control the product flow to mooring buoy 10 and to permit recirculation back to the permanent storage facility 23 for purging flowlines 22, as may be required. Manifold 20 has a plurality of water tight compartments 24 therein which may be flooded with or emptied of water as desired for positioning manifold 20 at a predetermined water depth. A plurality of support chains 26 are coupled between support manifold 20 and the bottom of mooring buoy 10.

To connect product flowlines 22 to mooring buoy 10 from a manifold 20 for the supply of product to supply product lines 16, flexible connecting product flowlines generally indicated at 30 are provided. Each connecting flowline 30 is formed of a plurality of flexible hose sections 32 of a predetermined length and selectively coupled to each other. While only one manifold 20 is shown in FIG. 3, two or more similar additional manifolds 20 may be provided as desired.

Installation of Product Flowlines

For installing product flowlines from permanent storage facility 23 to offloading mooring buoy 10 which may be separated from each other a distance one thousand (1,000) to fifteen hundred (1,500) meters, product flowlines 22 which are normally formed of steel pipe are connected to pipeline manifold 20 at permanent storage facility 23 and are then towed to catenary anchor leg mooring buoy 10. Manifold support chains 26 are then connected from manifold 20 to the bottom of buoy 10 at sea level. Next, water tight compartments 24 in manifold 20 are flooded with a predetermined amount of water to sink manifold 20 to a desired water depth beneath buoy 10. In this position, connecting flowlines 30 are mounted between manifold 20 and CALM buoy 10 to provide a product flow path to buoy 10 from permanent storage facility 23.

Flexible connecting flowlines 30 using flexible hose sections 32 may be connected to each other by flexible connecting joints, if desired, to provide substantial flexibility between pipeline manifold (SPLEM) 20 and offloading mooring buoy 10, thereby minimizing any undesired stresses transmitted to pipeline manifold 20 which result from differential motions of offloading mooring buoy 10 or permanent storage facility 23 with respect to the SPLEM 20.

Figure 4:
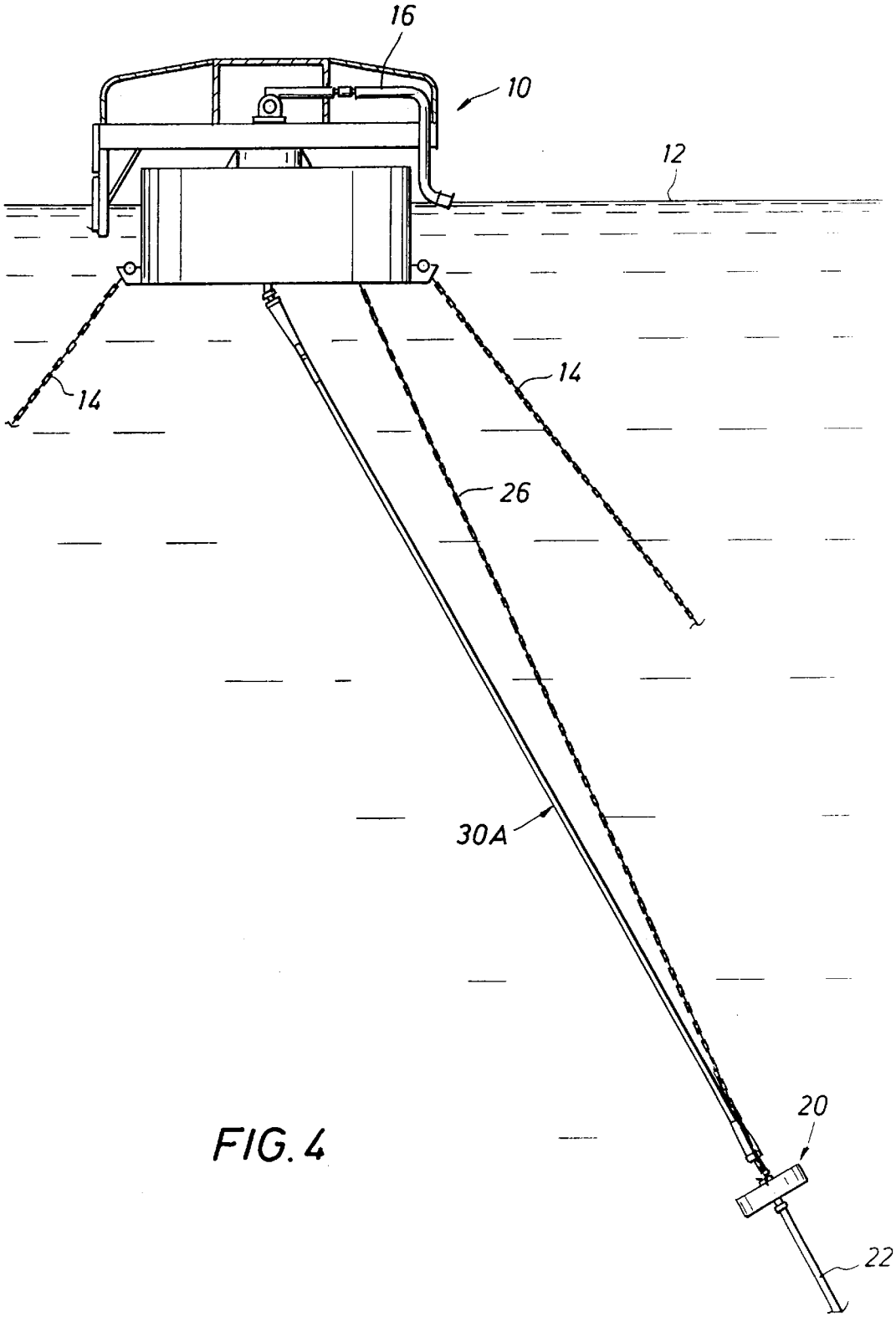
FIGS. 4–6 are views similar to respective FIGS. 1–3 but showing modified flexible risers or pipes forming the connecting product flowlines between the pipeline manifold and the offloading mooring buoy.
Figure 6:
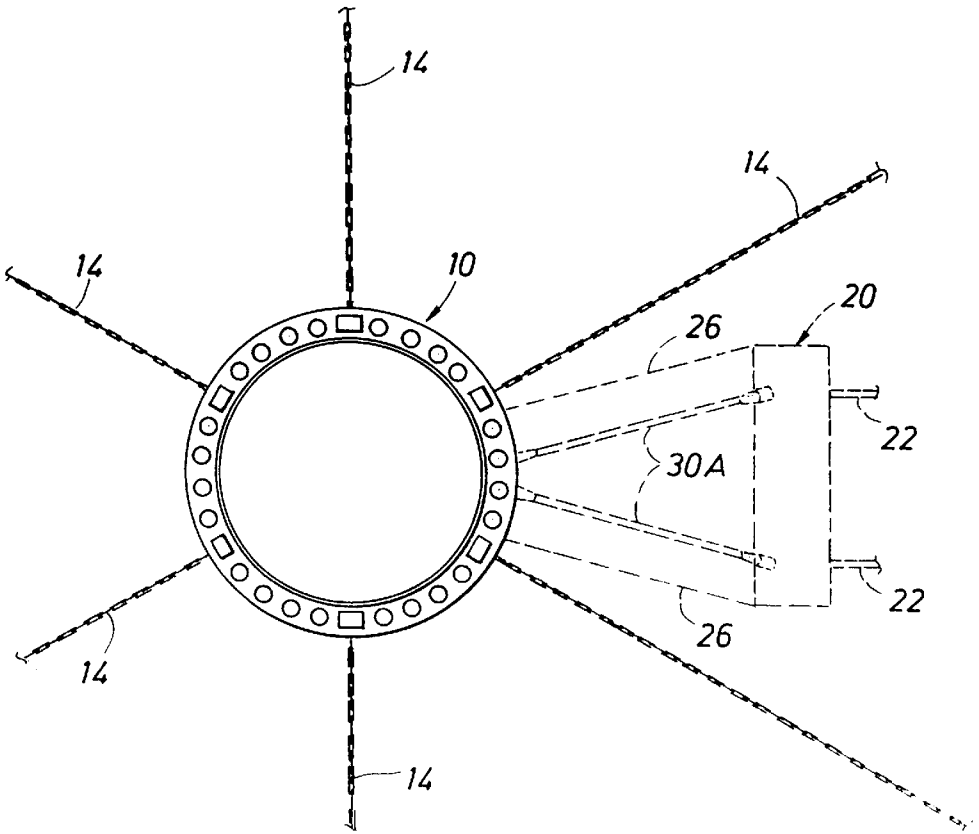
Figure 5:
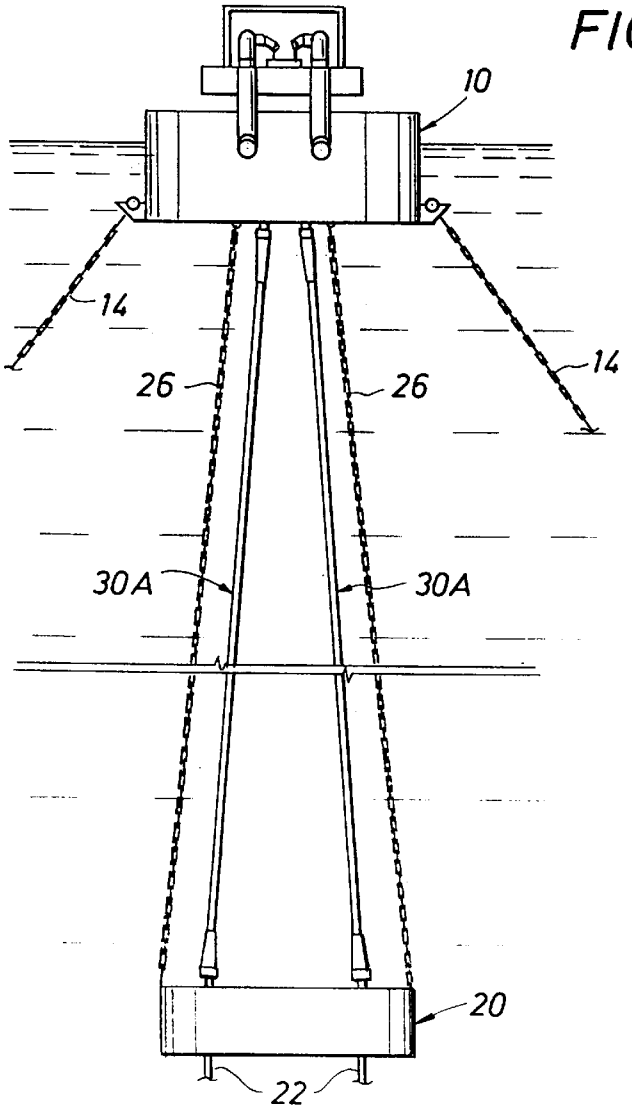

Embodiment Shown in FIGS. 4–6

The embodiment of the invention shown in FIGS. 4–6 is substantially identical to the embodiment shown in FIGS. 1–3 except for the connecting flowlines 30A shown in FIGS. 4–6 extending between pipeline manifold 20 and mooring buoy 10. Connecting product flowlines 30A comprise flexible metal risers which provide sufficient flexibility between buoy 10 and manifold 20 to minimize undesired stresses between buoy 10 and product manifold 20. The reference numbers embodiment of FIGS. 4–6 for similar parts are identical to the reference numbers shown in the embodiment of FIGS. 1–3.

While the present invention has been illustrated for installing product flowlines between a permanent product storage facility and an offloading mooring buoy, the installation method can be used for the attachment of product flowlines between two floating facilities or vessels separated by a substantial distance of about five hundred (500) meters, for example, such as monohulls, tension leg platforms, or semi-submersibles.

What is claimed is:

1. An offshore fluid transferring arrangement comprising, a permanent storage facility for fluids, a floating offloading facility that is arranged and designed for transferring fluid to a product transport facility, a first pipeline which has a first end coupled to said permanent storage facility, said first pipeline having a second end, a submerged pipeline terminating device including a first input flowline to which said second end of said first pipeline is coupled, said terminating device having an output flowline in communication with said first input flowline, flexible support leads coupled between said floating offloading facility and said submerged pipeline terminating device which support said terminating device at a submerged location beneath said floating offloading facility, a flexible connecting product flowline coupled to said output flowline of said terminating device and said floating offloading facility, and said pipeline terminating device including at least one floodable water tight compartment, which when flooded cause said pipeline terminating device to sink to a submerged position with support from said flexible support leads.

2. The fluid transferring arrangement of claim 1 further comprising, a second pipeline having a first end coupled to said permanent storage facility, said second pipeline having a second end, and wherein said submerged pipeline terminating device has a manifold having first and second input flowlines to which said second ends of said first pipeline and said second pipeline are coupled, said first and second input flowlines being in fluid communication with said output flowline.

3. The fluid transferring arrangement of claim 2 wherein, said submerged pipeline terminating device includes a plurality of manifolds, each of which connects at least two pipelines from said permanent storage facility to at least one flexible connecting product flowline, where each connecting product flowline is coupled to said floating offshore facility.

4. The fluid transferring arrangement of claim 1 wherein, said flexible connecting product flowline includes a plurality of flexible hose section coupled end to end.

5. The fluid transferring arrangement of claim 1 wherein, said flexible connecting product flowline is a flexible metal riser.

6. The fluid transferring arrangement of claim 1 wherein, said first pipeline is steel pipe.

7. The fluid transferring arrangement of claim 1 wherein, said permanent storage facility is a storage vessel.

8. The fluid transferring arrangement of claim 1 wherein, said permanent storage facility is a submerged storage facility supported from a seabed.

9. The fluid transferring arrangement of claim 1 wherein, said permanent storage facility is supported from a seabead.

10. A method of installing a product flowline between a permanent storage facility and a floating offshore facility comprising the steps of, delivering a product flowline having a first end and a second end to a permanent storage facility, connecting said first end of said product flowline to said permanent storage facility and connecting said second end of said product flowline to a buoyant pipeline terminating device, said pipeline terminating device having a water tight compartment for buoyancy, positioning said pipeline terminating device near a floating offshore facility that is arranged and designed for transferring fluid to a product transport facility, connecting flexible support leads between said pipeline terminating device and said floating offshore facility, sinking said pipeline terminating device by flooding said water tight compartment until said pipeline terminating device reaches an equilibrium submerged depth determined by the length of said flexible leads, and coupling a flowline between said pipeline terminating device and said floating offshore facility to provide a product flow path from said pipeline through said flowline to said floating offshore facility.

11. The method of claim 10 further comprising the steps of, providing a manifold on said pipeline terminating device, said manifold having multiple inputs and a single output, connecting multiple product flowlines between said permanent storage facility and said multiple inputs of said manifold on said pipeline terminating device, and coupling said flowline between said single output of said manifold and said floating offshore facility.

12. An offshore fluid transferring arrangement comprising, a storage facility for hydrocarbon fluids, an offloading buoy that is arranged and designed for floating on a sea surface and for transferring fluids to a tanker, said offloading buoy being secured to a sea floor by a plurality of anchor legs which extend from said sea floor to said offloading buoy;

a first pipeline which has a first end coupled to said storage facility, said first pipeline having a second end, a submerged pipeline terminating device including a first input flowline to which said second end of said first pipeline is coupled, said terminating device having an output flowline in communication with said first input flowline, flexible support leads coupled between said offloading buoy and said submerged pipeline terminating device which support said terminating device at a submerged location beneath said offloading buoy, and a flexible product flowline hose coupled to said output flowline of said terminating device and said offloading buoy, said flexible product flowline hose permitting pitching or rolling motions of said offloading buoy while reducing stress transferred to said submerged pipeline terminating device.

13. An offshore fluid transferring arrangement comprising, a storage facility for hydrocarbon fluids, an offloading buoy that is arranged and designed for floating on a sea surface and for transferring fluids to a tanker, said offloading buoy being secured to a sea floor by a plurality of anchor legs which extend from said sea floor to said offloading buoy;

a first pipeline which has a first end coupled to said storage facility, said first pipeline having a second end, a submerged pipeline terminating device including a first input flowline to which said second end of said first pipeline is coupled, said terminating device having an output flowline in communication with said first input flowline, flexible support leads coupled between said offloading buoy and said submerged pipeline terminating device which support said terminating device at a submerged location beneath said offloading buoy, and a flexible product flowline hose coupled to said output flowline of said terminating device and said offloading buoy, said flexible product flowline hose permitting pitching or rolling motions of said offloading buoy while reducing stress transferred to said submerged pipeline terminating device, wherein, said submerged pipeline terminating device includes a buoyancy chamber that can be ballasted with water so that said pipeline terminating device can sink to a submerged position with support from said flexible support leads.

* * * * *